United States Patent [19]

Wesson et al.

[11] Patent Number: 4,658,902

[45] Date of Patent: Apr. 21, 1987

[54] SURGING FLUIDS DOWNHOLE IN AN EARTH BOREHOLE

[75] Inventors: David S. Wesson, Katy; A. Glen Edwards, Hockley; Flint R. George, Katy; Kevin R. George, Barten Addition, all of Tex.; Emmert F. Brieger, Nogal, N. Mex.

[73] Assignee: Halliburton Company, Duncan, Okla.

[21] Appl. No.: 752,884

[22] Filed: Jul. 8, 1985

[51] Int. Cl.[4] ..... E21B 21/00

[52] U.S. Cl. ..... 166/317; 166/319

[58] Field of Search ..... 166/311, 312, 317, 319, 166/373, 376

[56] References Cited

U.S. PATENT DOCUMENTS 3,779,263 12/1973 Edwards et al. ..... 166/311 X 3,831,680 8/1974 Edwards et al. ..... 166/311

*Primary Examiner*—Stephen J. Novosad

*Assistant Examiner*—Thomas J. Odar

*Attorney, Agent, or Firm*—James R. Duzan

[57] ABSTRACT

Systems and methods for surging fluid downhole in an earth borehole, as well as tools especially adapted for use in such systems and methods, are disclosed. In a system for surging fluids, upper and lower valves both operated through the use of annulus pressure define the upper and lower extremities of a surge chamber. In a multiple surge system, first and second surge chambers are provided and a further valve is operative to surge fluids from the first surge chamber into the second surge chamber. A valve is disclosed having a longitudinal passageway initially closed by a breakable closure member. The valve is opened by breaking the closure member, and removing the broken closure member from the longitudinal passageway. The valve is operated by pressure differential between annulus pressure and atmospheric pressure which serves to accelerate a massive cutter member into the closure member for opening it. Also, a fluid pressure actuated apparatus especially useful in operating the upper valve is disclosed. A mechanism enables the operation of the valve in response to the elevation of fluid pressure within the valve, so that the operation of the upper valve with the use of annulus pressure is independent of the operation of the lower valve.

4 Claims, 8 Drawing Figures

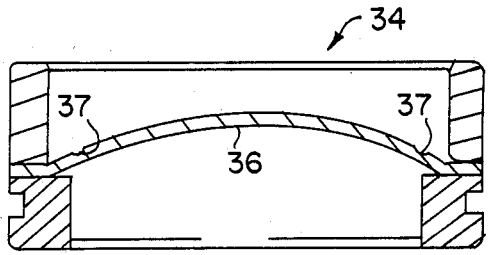
FIG. 3
FIG. 4A
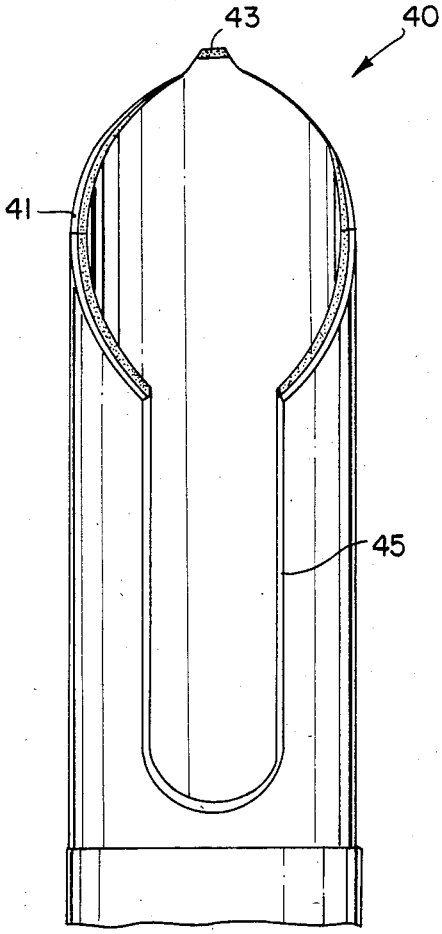
FIG. 4B
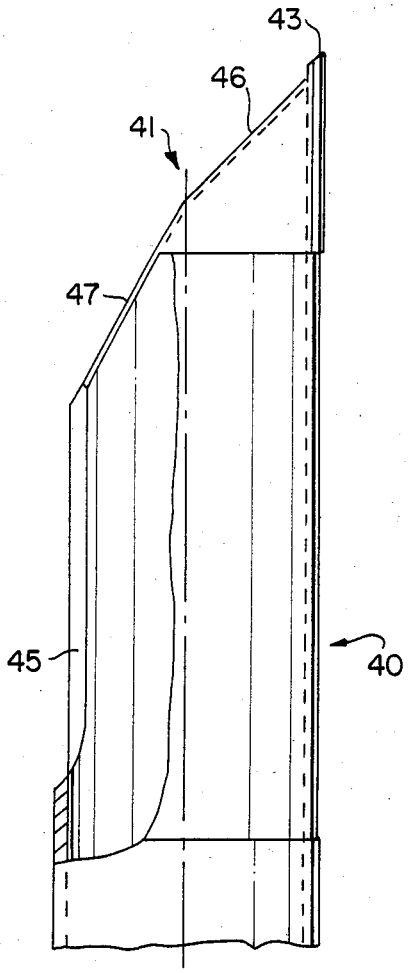

SURGING FLUIDS DOWNHOLE IN AN EARTH BOREHOLE

BACKGROUND OF THE INVENTION

The present invention relates to systems and methods for surging fluids downhole in an earth borehole, and for tools especially adapted for use in such systems and methods.

Surging is a technique useful in completing, treating and testing oil and gas wells. For example, backsurging is used to clean perforations by producing a high fluid pressure differential at the location of the perforations which results in turbulent flow through the perforations into the well. The technique is also useful for initiating flow tests which serve to estimate oil and gas reservoir extent and measure flow rates for a given formation. In sand control operations, the technique is used for forming a void outside the well casing so that gravel can be forced into the void to form a sand filter.

A number of different valves for use in surging wells have been described. For example, various types of ball valves, check valves and flapper valves have been proposed for use in surging techniques. Because a large pressure differential is present across the valve prior to actuation, valves of this type are prone to leak. For this reason, it has been proposed to use valves employing a frangible member which is shattered when the valve is opened. Such valves are better able to withstand high pressure differentials without leaking. However, loose pieces are formed by shattering the disc and these can clog or plug off the pipe string which is used to run the surging tools into the well.

In one such valve described in the prior art a frangible disc is broken by a cutter forced against the disc by a piston. The piston is powered by a fluid pressure differential across the piston produced by elevating upper annulus fluid pressure over fluid pressure trapped beneath the valve. The piston is free to move as the pressure is thus increased in the upper annulus. Accordingly, the cutter is urged against the disc as upper annulus fluid pressure is increased, so that when a sufficient pressure differential is produced, the cutter breaks through the disc, thus shattering it and releasing pieces of the disc into the flow of fluid through the valve.

There are several disadvantages in this design. Pieces from the shattered disc can form a blockage of the pipe string interfering with operations. Where a high pressure is trapped beneath the valve, it is necessary to produce a relatively high fluid pressure differential to break the disc. This may not be feasible if the necessary pressure level exceeds the pressure level which the casing can safely withstand. In order to accommodate such situations, breakable discs of differing thicknesses have been provided. Accordingly, a relatively thin disc will be used where it is not possible to safely produce a high pressure differential for actuating the tool. However, the availability of discs of varying thickness creates the possibility that a disc of the wrong thickness may be used. The result may be the spontaneous rupture of the disc if it is not sufficiently strong to withstand hydrostatic pressure in the well. If a disc having too great a thickness is used, it may not be possible to break it with the application of safe pressure levels in the upper annulus.

Where it is desired to surge into a chamber of limited volume, the prior art utilizes a second surge valve incorporating a second breakable disc forming the upper extremity of the surge chamber. In contrast to the operation of the lower valve, the upper valve is operated by increasing tubing pressure above the valve so that the tubing pressure sufficiently exceeds upper annulus pressure to force a cutter through the breakable disc. It will be readily appreciated that this valve shares many of the same disadvantages and limitations of the previously described valve. In addition, the use of tubing pressure to actuate the upper valve can force fluid and debris back into the perforations thus damaging the formation. It is also possible that the well's mud system can become contaminated by hydrocarbons if the packer is unseated before opening the upper valve to avoid forcing fluid and debris back into the perforations.

In a different prior art surging system, a surge chamber is formed between two removable plugs. Applying pressure to the annulus unseats the bottom plug in order to open the surge chamber to formation fluid. Thereafter, tubing pressure is increased to unseat the top plug so that both plugs are forced down the tool string and out the bottom of the tubing. Aside from forcing debris and fluid back into the perforations and the formation, this technique is not well adapted for producing a large pressure differential across the perforations, since fluid surges around the bottom plug as it is unseated.

In a further prior art surging system, a lower surge valve has a breakable disc shattered by dropping tubing weight on a disc cutter to force it through the disc. An upper surge valve has a breakable disc opened by dropping a bar down the tubing to strike the disc and shatter it. Such systems are expensive. Also, well operators prefer to avoid manipulating the tubing string. Where scale and other debris from the tubing string settle on the disc of the upper valve, the bar may not be able to shatter it upon impact.

SUMMARY

In accordance with one aspect of the present invention, a system is provided for surging fluids downhole in a borehole. In one exemplary embodiment, a surge chamber is formed between surge valve means in a pipe string at the downhole extremity of the surge chamber. An upper valve means is provided in the pipe string for controlling fluid flow between the surge chamber and the pipe string thereabove. The upper valve means is actuable from a closed to an open position in response to a fluid pressure differential between upper annulus fluid pressure and a fluid pressure value within the upper valve means less than upper annulus fluid pressure. Accordingly, it is unnecessary to increase tubing pressure above the formation pressure in order to open the upper valve means, so that the problem of elevated tubing pressure forcing debris and fluid back into the formation can be avoided.

In accordance with another aspect of the present invention a valve is provided which is adapted to be coupled to a pipe string downhole in a borehole. In one exemplary embodiment, the valve is provided with an elongated housing adapted to be coupled to a pipe string and having a longitudinal fluid passageway. A breakable closure member is positioned in the longitudinal passageway to initially close it. Means are provided for breaking the closure member to open the longitudinal passageway at the location of the closure member. In addition, means are provided for removing the broken closure member from the longitudinal passageway. Accordingly, large fragments from a broken closure member are not released into the tubing or pipe string where they can clog or plug it. The valve is especially well adapted for use in surging operations.

In accordance with yet another aspect of the present invention, a fluid pressure actuated tool for use downhole in a borehole is provided. In accordance with an exemplary embodiment, a piston is slidably positioned in a housing. The piston is positioned in an initial, inoperative position blocking the application of an actuating fluid pressure to a working surface thereof. Means are provided for moving the piston to an actuation position such that actuating fluid pressure is applied to the working surface of the piston. The tool is especially well adapted for use in actuating a surge valve having a breakable disc. In such an application, for example, atmospheric pressure is applied to one side of the piston. When it is desired to actuate the tool, the piston is moved to expose a port admitting annulus pressure into a chamber to which a second side of the piston is exposed. A very large pressure differential is thereby produced across the piston providing a large force for breaking the disc. It is, thus, possible to use a high strength disc which is not prone to break under hydrostatic pressure and which may be used in a large range of applications, even where hydrostatic pressure downhole is relatively low. This dispenses with the need to provide discs of various thicknesses and strengths to accommodate different hydrostatic pressure conditions through a wide range, since it is possible to exert sufficient force against the piston to break the high strength disc even where hydrostatic pressure is relatively low.

In accordance with another aspect of the present invention, a valve adapted to be coupled in a pipe string downhole in a borehole is provided. In one exemplary embodiment, the valve includes an elongated housing adapted to be coupled to a pipestring and having a longitudinal fluid passageway. A breakable closure member closes the longitudinal passageway. In addition, means are provided for breaking the closure member by the impact of a massive object thereagainst accelerated by means of fluid pressure. Since the object is accelerated, it stores kinetic energy which aids in breaking the closure member. It is especially advantageous to combine this feature in a tool as described above wherein an accelerating piston is driven by the pressure differential between hydrostatic pressure plus additional fluid pressure applied to the upper annulus, on one side of the piston, and atmospheric pressure on the other side of the piston.

In accordance with still another aspect of the present invention, a system is provided for surging fluids downhole in a borehole. In one exemplary embodiment, the system comprises a first housing defining a first surge chamber and means for opening the first surge chamber to surge fluids thereinto. A second housing is provided which defines a second surge chamber. In addition, means are provided for opening the second surge chamber to surge fluids from the first surge chamber into the second surge chamber. This system provides the capability of multiple sequential surging of a formation during a single trip into the borehole. It is, thus, possible to surge two or more times each with a controlled surge chamber volume. Pressure recordings may be taken during and after each surge to detect its effect.

BRIEF DESCRIPTION OF THE DRAWINGS

The present invention, as well as further objects and features thereof, will be understood more clearly and fully from the following description of certain preferred embodiments, when read with reference to the accompanying drawings, in which:

FIG. 3 is an enlarged cross-sectional view of a frangible disc incorporated in the upper and lower tools of FIGS. 1 and 2;

FIG. 4A is an elevational view of a portion of a cutter mandrel incorporated in the upper and lower tools of FIGS. 1 and 2;

FIG. 4B is an elevational view of the cutter mandrel of FIG. 4A rotated 90° with respect to the view of FIG. 4A and shown partially broken away;

DETAILED DESCRIPTION OF CERTAIN PREFERRED EMBODIMENTS

Figure 1:
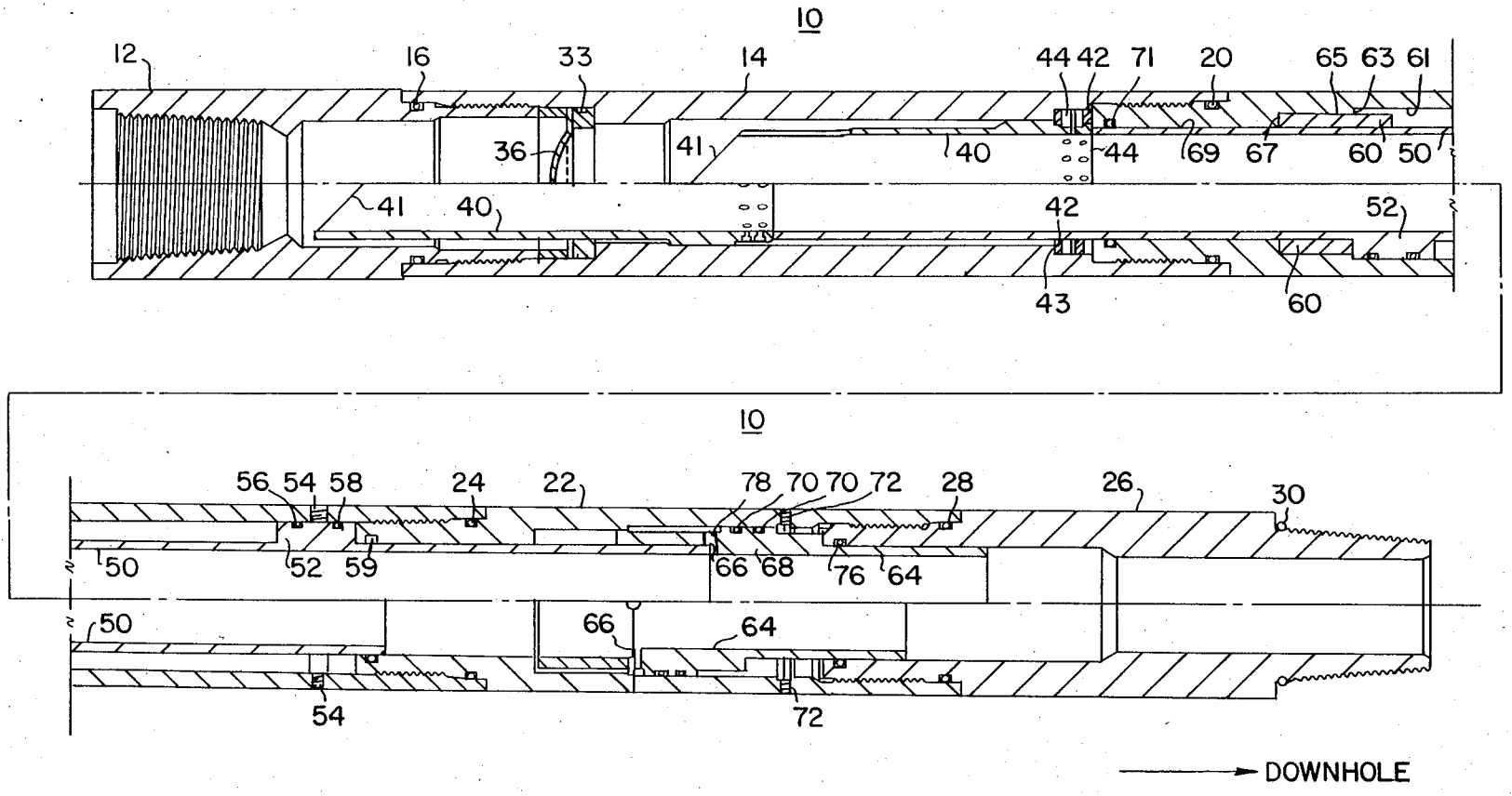
FIG. 1 combines a quarter sectional view of a lower surge valve tool in an unactuated configuration, with a quarter sectional view of the same tool after it has been actuated.
Figure 2:
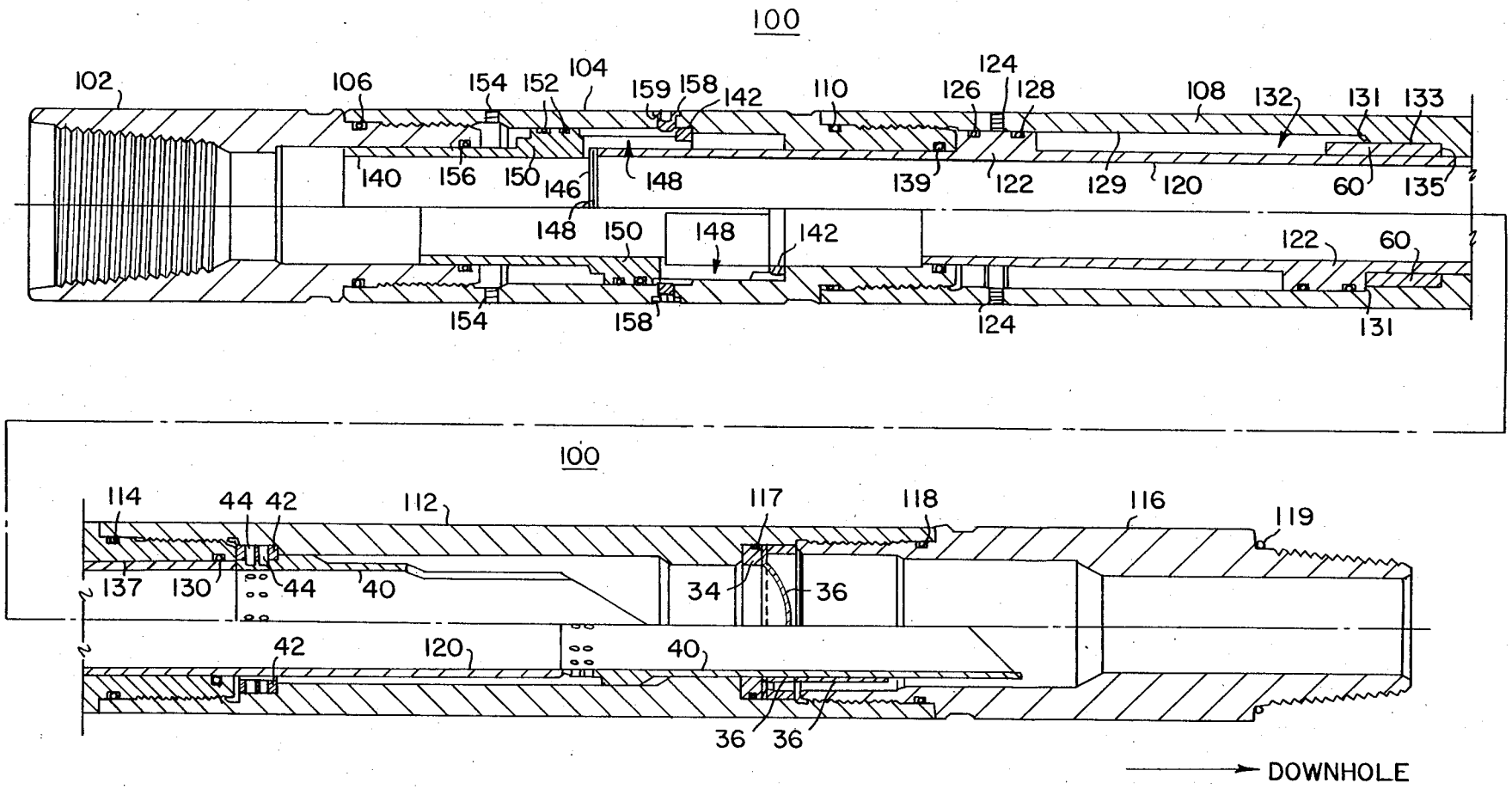
FIG. 2 combines a quarter sectional view of an upper surge valve tool in an unactuated configuration, with a quarter sectional view of the same tool after it has been actuated.

FIGS. 1 and 2 illustrate lower and upper valve tools, respectively designated 10 and 100, useful in a fluid surging system downhole in an earth borehole. The portion of each of FIGS. 1 and 2 above the center line thereof is a quarter sectional view of the valve prior to actuation, while the lower portion of each figure illustrates the valve after actuation.

With reference first to FIG. 1, the lower valve tool 10 includes an upper box coupling 12 threadedly coupled at a lower extremity thereof to an upper housing 14 and forming a fluid tight seal therewith by means of an O-ring seal 16. A middle housing 18 is threadedly coupled at an uphole extremity thereof to the lower extremity of upper housing 14 and forms a fluid tight seal therewith by means of a further O-ring seal 20. A lower housing 22 is threadedly coupled at an upper extremity thereof to middle housing 18 at its lower extremity and forms a fluid tight seal therewith by means of an O-ring seal 24. A pin coupling 26 at the lowermost extremity of tool 10 is threadedly coupled to the lower extremity of housing 22, and forms a fluid tight seal therewith by means of an O-ring seal 28. A further O-ring seal 30 is provided adjacent a lower, threaded portion of the pin coupling 26 for forming a fluid tight seal with a tool or pipe section coupled thereto. Each of elements 12, 14, 18, 22 and 26 has a generally tubular configuration so that together they form an elongated housing of the lower valve tool 10.

A disc assembly 34 is held between an inwardly extending shoulder of the upper housing 14 and the lower extremity of the box coupling 12. The disc assembly 34 includes a frangible disc 36 having a central curved section which is concave when viewed from the downhole direction. The radial outer surface of disc assembly 34 is sealed against an inner surface of upper housing 14 by means of an O-ring seal 33. The disc assembly 34 is illustrated in an enlarged cross-sectional view in FIG. 3. Frangible disc 36 is preferably formed from metal having an elongation of at least 40%. Metals which are appropriate for this purpose include certain nickel alloys, titanium alloys, copper alloys and aluminum alloys. For example, frangible disc 36 can be formed of Inconel 600 nickel alloy heat treated so that the alloy can achieve an elonqation of at least 40%. In addition, frangible disc 36 is made sufficiently thick to withstand downhole pressures.

A cutter mandrel 40 of generally tubular configuration forming a central longitudinal fluid passageway is releasably secured within the upper housing 14. Mandrel 40 has a cutting edge 41 at its upper extremity spaced from and aligned axially with the central curved section of frangible disc 36. With reference to FIG. 3, frangible disc 36 has a circular groove 37 formed in the surface thereof opposite cutter mandrel 40, which weakens the disc 36 to aid in cutting it. With reference also to FIGS. 4A and 4B, the cutting edge 41 of cutter mandrel 40 extends partially circumferentially about the upper extremity of mandrel 40. As seen best in FIG. 4B, the cutting edge 41 has an upper, semielliptical portion 46 which lies in a plane intersecting the longitudinal axis of mandrel 40 at an angle of 45°. The cutting edge 41 also has a lower portion 47 which lies in a plane intersecting the longitudinal axis of mandrel 40 at an angle of 30°. Since the cutter is forcing a portion of the disc laterally as it cuts, relatively greater force is required to cut along portion 47 than along portion 46. The smaller angle formed by portion 47 with the axis thereby increases the stroke of the cutter and the cutting force exerted thereby. It is also possible to arrange portions 46 and 47 as shown in FIG. 4B in an arcuate configuration.

As also seen in FIGS. 4A and 4B, a projection 43 extends longitudinally from the uppermost portion of cutting edge 41 and serves to initially puncture the disc 36 when cutter mandrel 40 impacts the disc, as described below. A longitudinal slot 45 extends downwardly from the lowermost portion of cutting edge 41 for a sufficiently long distance to ensure that the slot 45 does not extend beyond the disc 36 when it is cut by the mandrel 40. The width of the slot is selected so that the length of a line segment normal to the plane in which the two longitudinal outer edges of slot 45 lie and extending to the axis of mandrel 40 is substantially equal to the radial dimension of the longitudinal passageway of cutter mandrel 40. This ensures that the cross-sectional area of the longitudinal passageway is not restricted by the flap cut from disc 36, and also facilitates bending the flap laterally. By providing a slot in the cutting edge, mandrel 40 serves to cut a flap of metal attached to the central portion of disc 36 and then deflects the flap of metal laterally from the longitudinal fluid passageway of tool 10.

A shear ring 42 abuts a shoulder 43 of upper housing 14 facing in a downhole direction, such that shear ring 42 is prevented from moving uphole relative to upper housing 14. One or more shear pins 44 releasably hold the cutter mandrel 40 to the shear ring 42, so that the mandrel 40 is releasably prevented from sliding uphole within the upper housing 14 until the pins shear. The shear ring 42 is prevented from moving downhole by the upper extremity of middle housing 18.

A power mandrel 50 has a generally tubular configuration defining a longitudinal fluid passageway communicating with that of the cutter mandrel 40. Power mandrel 50 is initially positioned within the valve tool 10 extending from an upper extremity of the power mandrel 50 which abuts the lower extremity of the cutter mandrel 40 through the longitudinal passageway of middle housing 18 to a lower extremity of the power mandrel 50 positioned within lower housing 22 at a point approximately midway between its upper and lower extremities. A power piston 52 is formed integrally with power mandrel 50 and is positioned prior to actuation within the middle housing 18 such that an axial midpoint of a cylindrical outer surface of power piston 52 is aligned with a plurality of apertures 54 extending through the middle housing 18. A lower working surface of piston 52 abuts the upper extremity of lower housing 22, so that downward travel of piston 52 from its position in the upper half of FIG. 1 is prevented. A first O-ring seal 56 provides a fluid tight seal between an outer surface of the power piston 52 and an inner surface of middle housing 18 above the apertures 54, while a second O-ring seal 58 is positioned between the outer surface of the power piston 52 and the inner surface of the middle housing 18 at a position below the apertures 54. Accordingly, the power piston 52 together with the seals 56 and 58 initially isolate upper and lower working surfaces of the piston 52 from fluid pressure on the exterior of the valve tool 10.

An O-ring seal 59 forms a fluid tight seal between an outer surface of mandrel 50 below piston 52 and an inner surface of lower housing 22. Seals 24, 58 and 59 as shown in the unactuated position of valve sub 10 form a sealed chamber essentially at atmospheric pressure with the lower working surface of piston 52 forming the upper extremity thereof. An outer surface of mandrel 50 above piston 52 is spaced from an inner surface 61 of housing 18. The upper extremity of surface 61 is defined by a downwardly facing shoulder 63 which limits the upward travel of piston 52. A further inner surface 65 of housing 18 extends upwardly from shoulder 63 and is spaced from the outer surface of mandrel 50 to accommodate a tubular rubber shock absorber 60 which serves to decelerate piston 52 before it strikes shoulder 63. The upper extremity of surface 65 is defined by a further downwardly facing shoulder 67 which abuts the upper extremity of shock absorber 60. A still further inner surface 69 of housing 18 extends upwardly from shoulder 67 and fits closely with the outer surface of mandrel 50. An O-ring seal 71 forms a fluid tight seal between surface 69 and the outer surface of mandrel 50. Seals 56 and 71 trap air at atmospheric pressure between mandrel 50 and surface 61, so that the upper working surface of piston 52 works against a relatively low fluid pressure. O-ring seals 59 and 71 seal on equal diameters so that changes in pressure in the longitudial passageway produce no net force on mandrel 50.

An operating mandrel 64 having a generally tubular configuration extends from an upper extremity within lower housing 22 to a lower extremity within pin coupling 26. An upwardly facing shoulder 66 of operating mandrel 64 abuts the lower extremity of power mandrel 50, so that an upward force applied to operating mandrel 64 urges power mandrel 50 in an uphole direction. An operating piston 68 is formed integrally with operating mandrel 64 and has a cylindrical outer surface fitting closely within the inner surface of lower housing 22. A pair of O-ring seals 70 provide a fluid tight seal between lower and upper working surfaces of operating piston 68. A plurality of apertures 72 through lower housing 22 admit fluid pressure on the exterior of the valve tool 10 to a fluid pressure chamber formed between an outer surface of mandrel 64 beneath the operating piston 68 and an inner surface of lower housing 22. An upper extremity of the fluid pressure chamber is formed by the lower working surface of operating piston 68, and the lower extremity of the fluid chamber is formed by the upper extremity of pin coupling 26. A further O-ring seal 76 seals an outer surface of mandrel 64 with an inner surface of pin coupling 26. A plurality of apertures 78 extend radially through operating mandrel 64 above operating piston 68 to ensure that fluid pressure in the longitudinal passageway extending through the valve tool 10 is applied to the upper working surface of operating piston 68 and to permit free upward movement of piston 68 without trapping fluid above the piston.

With reference now to FIG. 2, upper valve tool 100 has an upper box connector 102 threadedly coupled to an upper housing 104 and forming a fluid tight seal therewith by means of an O-ring seal 106. A lower extremity of upper housing 104 is threadedly coupled to a middle housing 108 and forms a fluid tight seal therewith by means of a further O-ring seal 110. A lower housing 112 is threadedly coupled to a lower extremity of middle housing 108 and forms a fluid tight seal therewith by means of yet another O-ring seal 114. A pin coupling 116 forms the lower extremity of valve tool 100 and is threadedly coupled to the lower extremity of lower housing 112. An O-ring seal 118 forms a fluid tight seal between pin coupling 116 and lower housing 112. A further O-ring seal 119 is provided adjacent a lower, threaded portion of pin coupling 116 for forming a fluid tight seal with a tool or pipe section coupled thereto. Each of elements 102, 104, 108, 112 and 116 has a generally tubular configuration so that together they form a housing of upper valve tool 100.

A disc assembly 34 which is structurally identical with that shown in FIGS. 1 and 3, is held between a downwardly facing shoulder of lower housing 112 and the upper extremity of pin coupling 116. Disc assembly 34 supports the frangible disc 36 with its concave surface facing uphole. An O-ring seal 117 provides a fluid-tight seal between the outer surface of assembly 34 and an inner surface of lower housing 112. A cutter mandrel 40 structurally identical to that shown in FIGS. 1 and 4, is releasably held within lower housing 112 and has its cutting surface axially aligned and spaced from disc 36, as shown in the upper portion of FIG. 2. A shear ring 42 structurally identical to that shown in FIG. 1 is held between an upwardly facing shoulder of lower housing 112 and the lowermost extremity of middle housing 108. One or more shear pins 44 releasably hold cutter mandrel 40 to shear ring 42, and thus to lower housing 112.

A power mandrel 120 having a generally tubular configuration is initially positioned within middle housing 108 and extending upwardly into upper housing 104. Like cutter mandrel 40, and power mandrel 50 of FIG. 1, power mandrel 120 has a longitudinal passageway therethrough. A lower extremity of power mandrel 120 abuts an upper extremity of cutter mandrel 40. A power piston 122 is formed integrally with power mandrel 120 and has an outer cylindrical surface fitting closely against an inner surface of middle housing 108. An upper working surface of piston 122 abuts the lower extremity of upper housing 104 to prevent upward travel of piston 122 from its position as shown in the upper half of FIG. 2.

A plurality of apertures 124 extend through middle housing 108 to admit fluid pressure on the exterior of housing 108 to its interior. Power mandrel 120 is positioned initially such that power piston 122 is axially aligned with apertures 124. An O-ring seal 126 forms a fluid tight seal between the outer surface of piston 122 and the inner surface of middle housing 108 and is positioned initially slightly above the apertures 124. A second O-ring seal 128 likewise forms a fluid tight seal between the outer surface of piston 122 and the inner surface of middle housing 108, and is initially positioned just below the apertures 124. Accordingly, O-ring seals 126 and 128 initially prevent the application of fluid pressure on the exterior of middle housing 108 to the uppper and lower working surfaces of piston 122.

The exterior surface of the power mandrel 120 beneath the power piston 122 is spaced from an inner surface 129 of middle housing 108. The lower extremity of inner surface 129 is defined by an upwardly facing shoulder 131 which prevents further downward travel of piston 122. A further inner surface 133 spaced from the outer surface of mandrel 120 extends from shoulder 131 downwardly to a further upwardly facing shoulder 135. A still further inner surface 137 of housing 108 extends from shoulder 135 to the lower extremity of housing 108.

Adjacent the lower extremity of power mandrel 120 in its initial position is an O-ring seal 130 which forms a fluid tight seal between the outer surface of power mandrel 120 and the inner surface 137 of middle housing 108. Therefore, a fluid tight chamber 132 is formed between the outer surface of power mandrel 120 below the power piston 122 and the inner surface 129 of the middle housing 108. Since the tool 100 will be assembled before it is run into the well, the fluid tight chamber 132 will contain air at essentially atmospheric pressure. A cylindrical rubber shock absorber 60 structurally identical with that shown in FIG. 1 abuts shoulder 135 of middle housing 108 and extends upwardly within the air chamber 132 between surface 133 and the outer surface of mandrel 120. Like the corresponding element of FIG. 1, shock absorber 60 serves to decelerate power piston 122, as further explained below. Another O-ring seal 139 seals an outer surface of power mandrel 120 above piston 122 against an inner surface of upper housing 104. Seals 110, 126 and 139 maintain atmospheric pressure against the upper surface of piston 122 when it is in its initial position as shown in the upper portion of FIG. 2, so that power piston 122 is essentially pressure balanced in this position.

An operating mandrel 140 having a generally tubular configuration is positioned within box connector 102 and upper housing 104. Operating mandrel 140 has a longitudinal fluid passageway extending therethrough and communicating with that of mandrel 120. A lower extremity of mandrel 140 has a downwardly facing shoulder in which, as shown in the upper portion of FIG. 2, a resilient C-ring 142 is positioned. C-ring 142 is held in a radially expanded condition against the lower extremity of mandrel 140. At its lowest extremity, C-ring 142 as retained by mandrel 140 abuts an upwardly facing shoulder of upper housing 104, thus preventing downward travel of the operating mandrel 140 in this configuration.

The upper extremity of power mandrel 120 is telescopically received within the lower extremity of operating mandrel 140. A downwardly facing shoulder 146 of mandrel 140 opposes the upper extremity of power mandrel 120 and, as shown in the upper portion of FIG. 2, is spaced slightly therefrom prior to operation. The lower extremity of mandrel 140 is provided with four axially downwardly extending slots 148 equally spaced from one another circumferentially.

An operating piston 150 is formed integrally with operating mandrel 140 and has an outer cylindrical surface fitting closely against the inner surface of upper housing 104. A pair of O-ring seals 152 form a fluid tight seal between the outer surface of piston 150 and the inner surface of upper housing 104. A lower working surface of piston 150 is exposed to fluid pressure in the longitudinal passageway by virtue of the slots 148. An upper working surface of piston 150 is exposed to fluid pressure on the exterior of the valve sub 100 through a plurality of apertures 154 formed through upper housing 104 above operating piston 150. A further O-ring seal 156 forms a fluid tight seal between the outer surface of operating mandrel 140 and the inner surface of box connector 102. Seals 152 and 156 isolate fluid pressure admitted through apertures 154 from fluid pressure in the longitudinal passageway within valve sub 100.

A plurality of plugs 158 are threadedly held within a corresponding number of apertures through upper housing 104 and extend radially inwardly of the inner surface thereof spaced slightly above C-ring 142. Each plug 158 has an O-ring seal 159 sealing its outer surface against the upper housing 104. C-ring 142 in its expanded configuration on the lower extremity of mandrel 140 extends radially beyond the inner extent of plugs 158, so that upward motion of mandrel 140 will cause the C-ring 142 to abut the plugs 158, thus tending to slide the C-ring 142 off the mandrel 140.

Figure 5:
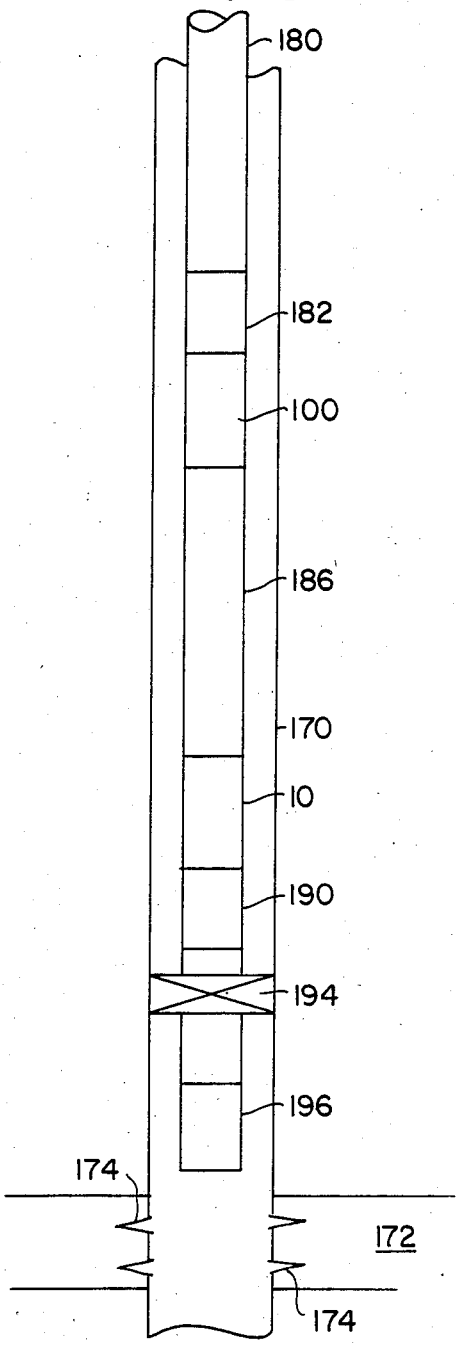
FIG. 5 is a schematic view of an earth borehole in which a tool string incorporating a surging system employing the valves of FIGS. 1 and 2 and a single surge chamber, has been positioned.

One advantageous embodiment of a fluid surging system utilizing the valve subs of FIGS. 1 and 2 is illustrated schematically in FIG. 5. In the diagram of FIG. 5, a casing 170 lines an earth borehole which extends through a hydrocarbon containing formation 172. The casing 170 has previously been perforated as shown, for example, at 174 and it is desired to backsurge the perforations 174, for example, to clean skin and debris from the perforations, to conduct a flow test, or as a preliminary step prior to gravel packing the formation 172. A pipe string 180 has been run into the well. The pipe string suspends a tool string especially adapted for conducting the backsurge operation. A circulating valve 182 is coupled at its upper extremity to the pipe string 180 and at its lower extremity to the upper valve tool 100 described hereinabove. Circulating valve 182 is held in an open position as it is run into the well.

One or more pipe sections 186 are coupled to the lower extremity of valve tool 100 to form the lateral walls of a surge chamber. The lowermost section of pipe 186 is coupled to the upper extremity of lower valve tool 10 described hereinabove. The lower extremity of valve tool 10 is coupled to a further circulating valve 190 which is run into the well open, but is closed by setting down weight against a retrievable packer 194 connected to the tool string below the circulating valve 190. At the lower extremity of the tool string is a gauge carrier 196 which mounts one or more gauges for recording downhole data. The lowermost extremity of the gauge carrier 196 is positioned above the perforations 174, so that debris which may flow into the well through the perforations 174 upon backsurging does not bind the tool string in the well. The bottom of the gauge carrier 196 is open to well fluids which are allowed to flow therethrough to fill the tool string up to the breakable disc of valve 10.

When the pipe string is run into the well, it is allowed to fill through the circulating valve 182. At the same time, circulating valve 190 permits well fluid beneath the packer 194 to flow upwardly within it to the borehole above, so packer 194 does not produce a piston effect. The tool string is lowered to the desired depth and the packer 194 is set. Weight is set down on the packer 194 to close the circulating valves 182 and 190. Then the pipe string 180 is filled to the top with liquid.

Valve 10 is then opened by applying fluid pressure to the upper annulus of the well at the surface. With reference also to FIG. 1, the increased annulus pressure is applied through apertures 72 to the lower working surface of operating piston 68. The upward force produced by the pressure differential between upper annulus pressure and hydrostatic pressure trapped within the valve 10 below the disc 36 produces an upward force on the piston 68. This force is transmitted through the power mandrel 50 to the cutter mandrel 40. When sufficient pressure is applied to the upper annulus, the upward force on the cutter mandrel 40 becomes sufficiently great to shear the pins 44, thus permitting the operating mandrel 64, the power mandrel 50 and the cutter mandrel 40 to move upwardly. Upward motion of the power mandrel 50 soon exposes the lower working surface of power piston 52 to upper annulus pressure. The large fluid pressure differential between upper annulus pressure and the essentially atmospheric pressure acting on the upper working surface of piston 52 produces a large unbalanced force across the piston 52 in the upward direction. Accordingly, the power mandrel 50 and the cutter 40 are very rapidly accelerated in an upward direction. When the projection 43 of the cutter mandrel 40 impacts the frangible disc 36, the cutter mandrel is moving at high velocity toward the disc 36. The projection 43 punctures the frangible disc 36 and the cutting edge 41 cuts a metal flap from the central portion of the disc 36, which, however, remains attached to the disc adjacent the slot 45 of the cutter mandrel 40. As the cutter mandrel continues upwardly, the metal flap of the frangible disc 36 is deflected laterally from the longitudinal passageway of the valve tool 10 and is retained therein between the outer surface of the cutter mandrel 40 and an inner surface of the box connector 12. Accordingly, substantially all of the frangible disc 36 is retained within the valve sub 10 since the flap remains attached to the remainder of the disc assembly 34.

The rapid opening of the frangible disc produces a surge of fluid from beneath the disc into the surge chamber defined by the pipe sections 186. This produces a large pressure differential across the perforations 174, for producing the desired backsurging effect. It will be appreciated that the volume of fluid and debris backsurged through the perforations 174 can be adjusted by adjusting the volume of the surge chamber, and that the pressure differential across the perforations 174 can be adjusted through the control of fluid head between valve 10 and perforations 174.

Fluid and debris now fill the surge chamber. This material can be reverse circulated upwardly through the pipe string 180 to the surface by opening the valve 100 and unseating the packer 194 to form a reverse circulation path. With reference now to FIG. 2, it will be seen that the prior application of upper annulus pressure to open the lower valve 10 will not have been effective to open the valve 100 since the C-ring 142 prevents downward movement of the operating piston 150 thereof. In order to enable the upper surge valve 100 to open by means of elevated annulus pressure, fluid pressure in excess of annulus pressure is applied down the pipe string 180, so that piston 150 is forced upwardly. The resulting upward motion of operating mandrel 140 brings the C-ring 142 into abutment with the plugs 158, thus sliding the C-ring 142 off the mandrel 140. The C-ring 142 thereupon compresses inwardly to assume its normal, unstressed configuration. In its unstressed configuration, C-ring 142 has an outer diameter smaller than the inner diameter of upper housing 104 beneath the shoulder which previously abutted the C-ring 142. Accordingly, the operating mandrel 140 is now free to travel downwardly to urge the power mandrel 120 and the cutter mandrel 40 in the downward direction.

The application of tubing pressure above the disc in excess of annulus pressure thus serves to unlock the upper surge valve 100, so that the subsequent application of annulus pressure in excess of pressure within the valve 100 forces the piston 150 downwardly so that a shear force is exerted by the cutter mandrel 40 against the shear pins 44. When annulus pressure becomes sufficiently large, the force exerted by cutter mandrel 40 shears the pins 44, thus permitting the operating mandrel 140, the power mandrel 120 and the cutter mandrel 40 to slide downwardly toward the frangible disc 36. As in the case of the valve 10 of FIG. 1, this soon exposes the upper working surface of the piston 122 to upper annulus pressure, so that a very large pressure differential is applied across the piston 122. The operation of valve 100 from this point on is essentially the same as that of the valve 10 of FIG. 1. As shown in the lower portions of both FIGS. 1 and 2, the resilient shock absorber 60 decelerates the power piston to a substantial extent before it impacts the shoulder (63 in FIG. 1 or 131 in FIG. 2). It is also possible to substitute valve tool 10 for valve 100. In this case, valve tool 10 is inverted from the position shown in FIG. 1 and shear pinned at a higher applied annulus pressure than the lower valve 10.

Since the valve 100 is actuated by annulus pressure, it is possible to maintain pressure within the pipe string 180 substantially at the formation pressure at the time valve 100 is opened. Consequently, fluid and debris are not forced back through perforations 174 at this time. Also, fluid and debris which previously entered the tool string and the surge chamber are not forced back into the isolated interval beneath the packer 194, and the likelihood that the mud system will become contaminated with hydrocarbons when the packer 194 is unseated is reduced. Once the packer 194 has been unseated, formation fluid and debris are reverse circulated out of the well through pipe string 180 and then the tools are removed from the well. In the alternative, additional operations such as acidizing can be performed before removing the tools from the well.

Figure 6:
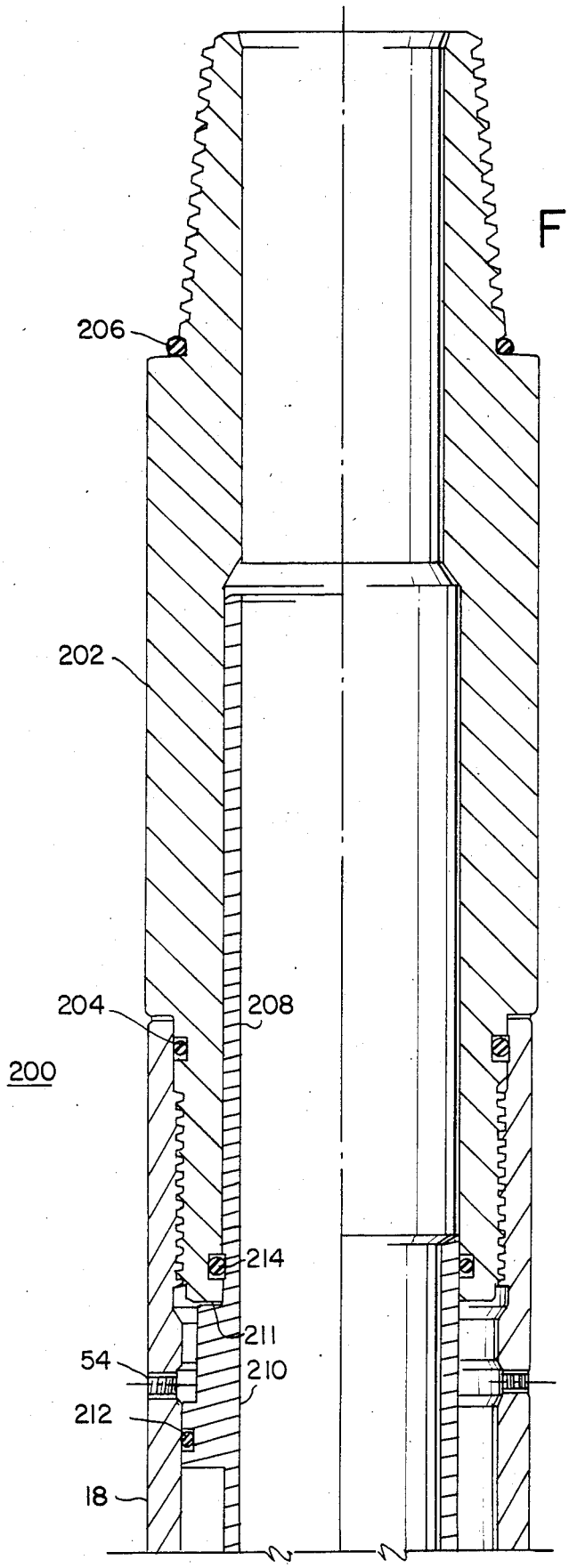
FIG. 6 combines a quarter sectional view of a modified portion of a lower surge valve tool in an unactuated configuration, with a quarter sectional view of the same portion after it has been actuated.

FIG. 6 illustrates a modification of the valve 10 as shown in FIG. 1 which permits the practice of a multiple sequential surge technique, as described hereinbelow in connection with FIG. 7. In the modification of FIG. 6, the portion thereof above the center line is a quarter sectional view prior to actuation, while the portion thereof below the center line is a quarter sectional view after actuation. Elements corresponding to those of lower surge valve 10 of FIG. 1 have the same reference numerals, and all elements thereof not illustrated in FIG. 6 are identical to those previously described in connection with FIG. 1.

The modified lower surge tool 200 of FIG. 6 has a lower pin coupling 202 similar in construction to pin coupling 26 of FIG. 1 and threadedly coupled to the middle housing 18. Accordingly, the lower housing 22 has been dispensed with. An O-ring seal 204 forms a fluid tight seal between the housing 18 and the pin coupling 202. An O-ring seal 206 serves the same purpose as the O-ring 30 of FIG. 1.

In the modified valve 200, the operating mandrel 64 has been removed and the lower extremity of a modified power mandrel 208 is telescopically received within an enlarged inner diameter portion of the pin coupling 202. A modified power piston 210 is formed integrally with power mandrel 208. A portion 211 of a lower working surface of piston 210 abuts the upper extremity of pin coupling 202, which thus limits the downward travel of the piston 210. The piston 210 has a first outer surface extending from portion 211 upwardly to an enlarged outer diameter section of piston 210 having an outer surface fitting closely against the inner surface of the housing 18. The enlarged outer surface of piston 210 carries an O-ring seal 212 which forms a fluid tight seal between the enlarged outer surface of the piston and the inner surface of the housing 18. It will be seen that, contrary to the embodiment of FIG. 1, the embodiment of FIG. 6 permits the continuous application of fluid pressure from the exterior of the valve 200 to the lower working surfaces of power piston 210 through apertures 54. Accordingly, shear pins 44 are selected to withstand the force produced by total annular hydrostatic pressure plus the operating pressure of valve 200. A further O-ring 214 forms a fluid tight seal between the inner surface of the pin coupling 202 and the outer surface of the power mandrel 208 beneath the power piston 210. Accordingly, fluid pressure from the exterior of valve 200 is isolated from the longitudinal passageway thereof by means of the O-ring seals 212 and 214.

Figure 7:
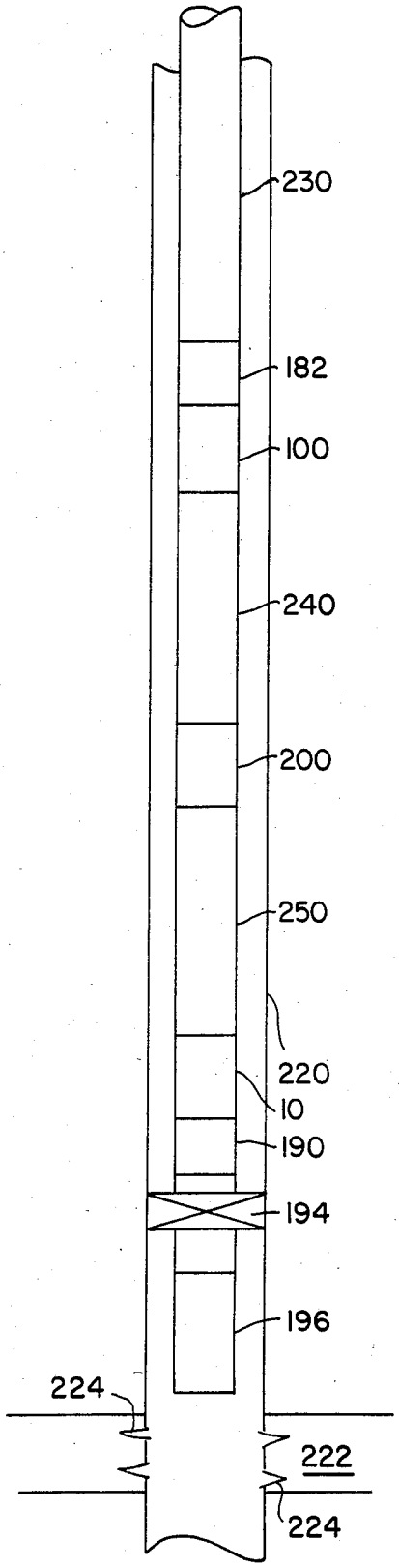
FIG. 7 is a schematic view of an earth borehole in which a surge system incorporating multiple surge chambers has been positioned.

In the schematic view of FIG. 7, an earth borehole is lined by a casing 220, which extends to a hydrocarbon containing formation 222. The casing 220 has previously been perforated as shown, for example, at 224 and it is desired to sequentially backsurge these perforations two or more times on a single trip into the well. For this purpose, a pipe string 230 suspending a multiple surge tool string is run into the well. The circulating valve 182 described previously in connection with FIG. 5 is coupled at its upper extremity to the pipe string 230 and at its lower extremity to the upper surge valve 100. The lower extremity of the surge valve 100 is coupled to a string of one or more pipe sections 240 which define the lateral walls of an upper surge chamber. The modified lower surge valve 200 is coupled to the lowermost pipe section of the string 240. A second string of pipe sections 250 is coupled at its upper extremity to modified lower surge valve 200 and defines the lateral walls of a lower surge chamber. The lowermost section of pipe in the string 250 is coupled to the upper extremity of the lower surge valve 10, whose lower extremity is coupled to the circulating valve 190. The retrievable packer 194 is coupled in the tool string beneath the circulating valve 190 and the lowermost portion of the tool string is defined by the gauge carrier 196, described above in connection with FIG. 5. As in the FIG. 5 embodiment, the lowermost extremity of the gauge carrier 196 is positioned above the perforations 224.

As in the case of the FIG. 5 embodiment, the circulating valve 190 is run into the well open so that well fluids can bypass the packer 194 by flowing through the gauge carrier and outwardly of the circulating valve 190 as the tool string is lowered. Also, as described above, the circulating valve 182 is run in open, thus permitting the pipe string 230 to fill as the tool string is lowered into the well. When the tool string has been lowered to the appropriate depth, the packer 194 is set and as weight is set down on the packer, circulating valves 182 and 190 both close. To perform the first backsurge operation, annulus pressure is increased until the valve 10 opens, as described above, to surge fluids into the surge chamber defined by the pipe string 250. Lower surge valve 10 is shear pinned so that it opens when annulus pressure exceeds a first fluid pressure level. Valve 200 is shear pinned to be actuated at a higher annulus fluid pressure level than valve 10. In this manner, it is possible to open the valve 10, without also opening the valve 200.

When it is desired to perform the second surge, annulus pressure is increased sufficiently to actuate the valve 200 so that fluid surges into the upper surge chamber defined by the pipe string 240. Thereafter, as in the case of the FIG. 5 embodiment, the upper surge valve 100 is opened, the packer is unseated, and formation fluid and debris is reverse circulated from the well to the pipe string 230. Thereafter the tools are removed from the well.

Where it is desired to perform more than two surges on a single trip into the well, a corresponding number of surge chambers are formed serially in the tool string. The second and higher chambers are each separated from the next lower chamber by a respective valve constructed in the same manner as valve 200. Each such valve is shear pinned to open with an annulus fluid pressure incrementally higher than that at which the next lower valve opens. In this manner the valves can be opened sequentially to provide three or more successive surges.

In practicing the methods described above, detection of the operation of the surge valves at the wellhead is accomplished with the use of the transducer and recorder apparatus disclosed in U.S. patent application Ser. No. 505,911 filed June 20, 1983 entitled: METHOD AND APPARATUS FOR DETECTING FIRING OF PERFORATING GUN. Briefly, a transducer in the form of an accelerometer is attached to the pipe string at the wellhead. The accelerometer is coupled by an electrical conductor to the recorder apparatus which provides a display to an operator indicating the accelerations of the pipe string. As the valves are opened, the pipe string accelerates. The accelerometer transduces this acceleration into an electrical signal and the recorder provides a display to the operator indicating the acceleration of the pipe string. Once this occurs, it is known that a valve has opened and pressure can be released from the well annulus. The ability to detect valve operation in this manner is especially important in the practice of the method illustrated in FIG. 7, since the lower surge valves 10 and 200, which are both actuated by sufficiently elevating annulus pressure, nevertheless need to be operated at different times.

Accordingly, once it is detected at the wellhead that valve 10 has opened, annulus pressure is reduced to avoid inadvertently actuating valve or valves 200. It is also possible in this manner for an observer remote from the wellhead to detect valve actuation, so that the danger of injury from malfunctioning wellhead equipment under pressure is reduced.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

What is claimed is:

1. An annulus pressure resonsive surge tool for use in a conduit string in a well bore having fluid therein filling the annulus between said conduit string and said well bore, said annulus pressure responsive surge tool comprising:

a housing having a bore therethrough, a first aperture therein to allow communication of said fluid from the exterior of the housing to the bore therethrough, and a second aperture therein to allow communication of said fluid from the exterior of the housing to the bore therethrough;

a frangible closure member retained within the bore of the housing sealingly closing the same from fluid therethrough;

a first annular piston slidable within a portion of the bore of the housing having, in turn, a bore therethrough, a portion of the exterior of the first annular piston sealingly engaging a portion of the bore of the housing to form a chamber containing a compressible fluid under pressure therein at a pressure less than the pressure of said fluid in said annulus, and a portion of the first annular piston in fluid communication through the first aperture in the housing with said fluid in said annulus;

a second annular piston slidable within a portion of the bore of the housing having, in turn, a bore therethrough, a portion of the second annular piston abutting a portion of the first piston, a portion of the second annular piston sealingly engaging a portion of the bore of the housing, and a portion of the second annular piston in fluid communication through the second aperture in the housing with said fluid in said annulus; and first releasable locking means retained within a portion of the bore in the housing having a portion thereof releasably retaining the first piston in a first position in the bore in the housing whereby upon increasing the pressure of said fluid in said annulus above a predetermined level, the pressure of said fluid in said annulus causes the first piston and second piston to move relative to the housing thereby releasing the first piston from the releasable locking means allowing the continued movement of the first piston within the housing to be accelerated by the pressure differential between the pressure of said fluid in said annulus and the compressible fluid in the chamber between the housing and the first piston resulting in the first piston impacting the frangible closure member severing a portion thereof, being forced therethrough and deforming the severed portion of the frangible member out of sealing engagement with the bore of the housing thereby forming a flow path through said annulus pressure responsive surge tool.

2. The annulus pressure responsive surge tool of claim 1 further comprising:

second releasable locking means retained within a portion of the bore in the housing having a portion thereof releasably retaining the second piston in a first position in the bore in the housing.

3. The annulus pressure responsive surge tool of claim 2 further comprising:

a shock absorber member retained within a portion of the bore of the housing to decelerate the first piston within the housing after impacting the frangible closure member.

4. The annulus pressure responsive surge tool of claim 3 wherein the first annuluar piston comprises:

a cylindrical annular member having a cutting edge formed on one end thereof, the cutting edge extending partially circumferentially about a first extremity thereof and having a noncutting edge extending partially circumferentially about another extremity thereof whereby upon impacting the frangible closure member of said surge tool and being forced therethrough the cutting edge formed on the annular cylindrical piston partially severs a portion of the frangible closure member while the first annular piston deforms the partially severed closure member out of sealing closing engagement with the bore of the housing so that the portion of the frangible member severed remains attached to the remaining portion of the frangible member.

* * * * *